US006585273B2

(12) United States Patent
Chiu

(10) Patent No.: US 6,585,273 B2
(45) Date of Patent: Jul. 1, 2003

(54) HIDDEN DEVICE IN A MULTIFUNCTIONAL SPORTS SHOE

(76) Inventor: Michael Chiu, No. 1, Alley 16, Lane 40, Jinn Te Rd., Taichung City (TW)

( * ) Notice: Subject to any disclaimer, the term of this patent is extended or adjusted under 35 U.S.C. 154(b) by 351 days.

(21) Appl. No.: 09/756,711

(22) Filed: Jan. 10, 2001

(65) Prior Publication Data

US 2003/0025285 A1 Feb. 6, 2003

(51) Int. Cl.[7] ..... A63C 17/04

(52) U.S. Cl. ..... 280/11.223; 280/11.27; 280/11.221

(58) Field of Search ..... 280/11.223, 7.12, 280/7.14, 11.19, 11.224, 11.25, 11.27, 7.13, 843, 841, 11.221, 11.226, 11.227, 11.231, 11.233, 11.28; 36/115; 301/5.301, 5.305; D21/760

(56) References Cited

U.S. PATENT DOCUMENTS 3,884,485 A * 5/1975 Walle ..... 280/841
3,979,842 A * 9/1976 Texidor ..... 36/115
3,983,643 A * 10/1976 Schreyer et al. ..... 36/115
4,333,249 A * 6/1982 Schaefer ..... 36/115
6,086,072 A * 7/2000 Prus ..... 280/11.28
6,120,039 A * 9/2000 Clementi ..... 280/11.19
6,237,923 B1 * 5/2001 Fowle ..... 280/11.115
6,308,964 B1 * 10/2001 Chang ..... 280/11.19
6,336,644 B1 * 1/2002 Chu ..... 280/11.233
6,394,468 B1 * 5/2002 Chiang et al. ..... 280/11.223
6,402,162 B1 * 6/2002 Chiang ..... 280/11.233
6,406,307 B2 * 6/2002 Bungo et al. ..... 439/130
6,454,279 B1 * 9/2002 Yang ..... 280/11.223
6,464,236 B2 * 10/2002 Chang ..... 280/11.223
6,474,661 B1 * 11/2002 Chang ..... 280/11.19
2002/0089132 A1 * 7/2002 Chu ..... 280/11.223
2002/0145263 A1 * 10/2002 Yang ..... 280/11.19
2003/0001347 A1 * 1/2003 Chen et al. ..... 280/11.221
2003/0011151 A1 * 1/2003 Lai et al. ..... 280/11.223

* cited by examiner

*Primary Examiner*—Brian L. Johnson
*Assistant Examiner*—J. Allen Shriver
(74) *Attorney, Agent, or Firm*—Troxell Law Office PLLC

(57) ABSTRACT

A hidden device in a multifunctional sports shoe comprises a roller mechanism and an actuating mechanism. The roller mechanism is disposed under a bottom sole of the shoe and the actuating mechanism, being attached to the roller mechanism. The roller mechanism further comprises an upper base frame, a lower base frame, and four pairs of cross arms, a roller frame with lined up rollers. The upper and the lower base frames at two longitudinal lateral sides have elongated sliding grooves respectively for these pairs of cross arms slidably moving along. The upper base frame and the wheel seat frame are fastened to the bottom sole on the sports shoe. The actuation mechanism further comprises a shaft disposed next to an end of the upper base frame transversely. A ratchet wheel, two rolling wheels, and a rotary disk with a turning stem are provided on the shaft. A ratchet stop with a press knob engages with the ratchet wheel. The elastic cords join these pairs of cross arms and wound on the rolling wheels. While the press knob is pushed to move the ratchet stop away the ratchet wheel, the elastic forces of the elastic cords cause these pairs of cross arms pulled inward and result in the lower base frame moving upward for skating. While the turning stem is turned to cause the elastic cords are wound on the respective rolling wheel, these pairs of cross arms are moved outward under the condition of the ratchet wheel engaging with the stop and the lower base frame moves downward for walking.

2 Claims, 5 Drawing Sheets

HIDDEN DEVICE IN A MULTIFUNCTIONAL SPORTS SHOE

BACKGROUND OF THE INVENTION

1. Field of the Invention

The present invention relates to a hidden device in a multifunctional sports shoe, and particularly to a structure of a hidden device to improve a sports shoe as a shoe with multiple functions.

2. Description of Related Art

We all know that there are a lot of different kinds of shoes such as sports shoes, casual shoes, leather shoes, slippers nowadays and they are provided for different specific purposes. However, shoes made of prior art are unable to offer multiple functions with a single pair of shoes so that it is hard to satisfy those young persons, who love to pursue the trend of new and changing fashion. Consequently, it is necessary for them to own more shoes of different purposes and result in a financial burden for parents in order to meet the need of their children.

SUMMARY OF THE INVENTION

A primary object of the present invention is to provide a hidden device in a sport shoe, which is possible for the user to operate for sports or for waking as desired instead of a single function of prior art and to save expenses for buying other shoes.

In order to achieve the preceding object, the present invention comprises a roller mechanism and an actuating mechanism. The roller mechanism is disposed under a bottom sole of the shoe and the actuating mechanism, being attached to the roller mechanism. The roller mechanism further comprises an upper base frame, a lower base frame, and four pairs of cross arms, a roller frame with lined up rollers. The upper and the lower base frames at two longitudinal lateral sides thereof have elongated sliding grooves respectively for these pairs of cross arms slidably moving along. The upper base frame and the roller frame are fastened to the bottom sole on the sports shoe. The actuation mechanism further comprises a shaft disposed next to an end of the upper base frame transversely. A ratchet wheel, two rolling wheels, and a rotary disk with a turning stem are provided on the shaft. A ratchet stop with a press knob engages with. the ratchet wheel. The elastic cords join these pairs of cross arms and wound on the rolling wheels. While the press knob is pushed to move the ratchet stop away the ratchet wheel, the elastic forces of the elastic cords cause these pairs of cross arms pulled inward and result in the lower base frame moving upward for skating. While the turning stem is turned to cause the elastic cords are wound on the respective rolling wheel, these pairs of cross arms are moved outward under the condition of the ratchet wheel engaging with the stop and the lower base frame moves downward for walking.

BRIEF DESCRIPTION OF THE DRAWINGS

The detail structure, the applied principle, the function and the effectiveness of the present invention can be more fully understood by referring to the following description and accompanying drawings, in which.

DETAILED DESCRIPTION OF THE PREFERRED EMBODIMENT

Figure 1:
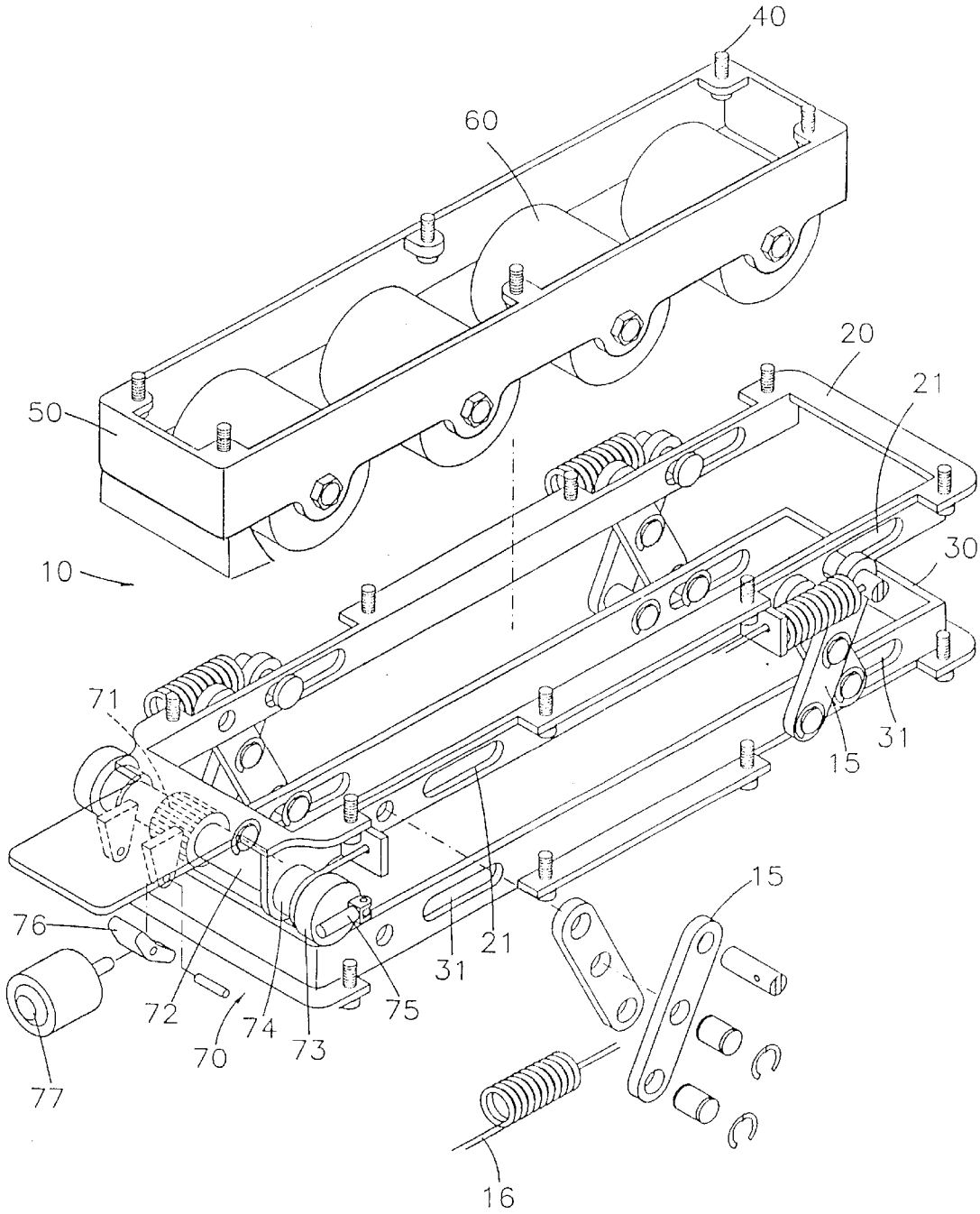
FIG. 1 is a disassembled perspective view of a hidden device in a multifunctional sports shoe according to the present invention.
Figure 2:
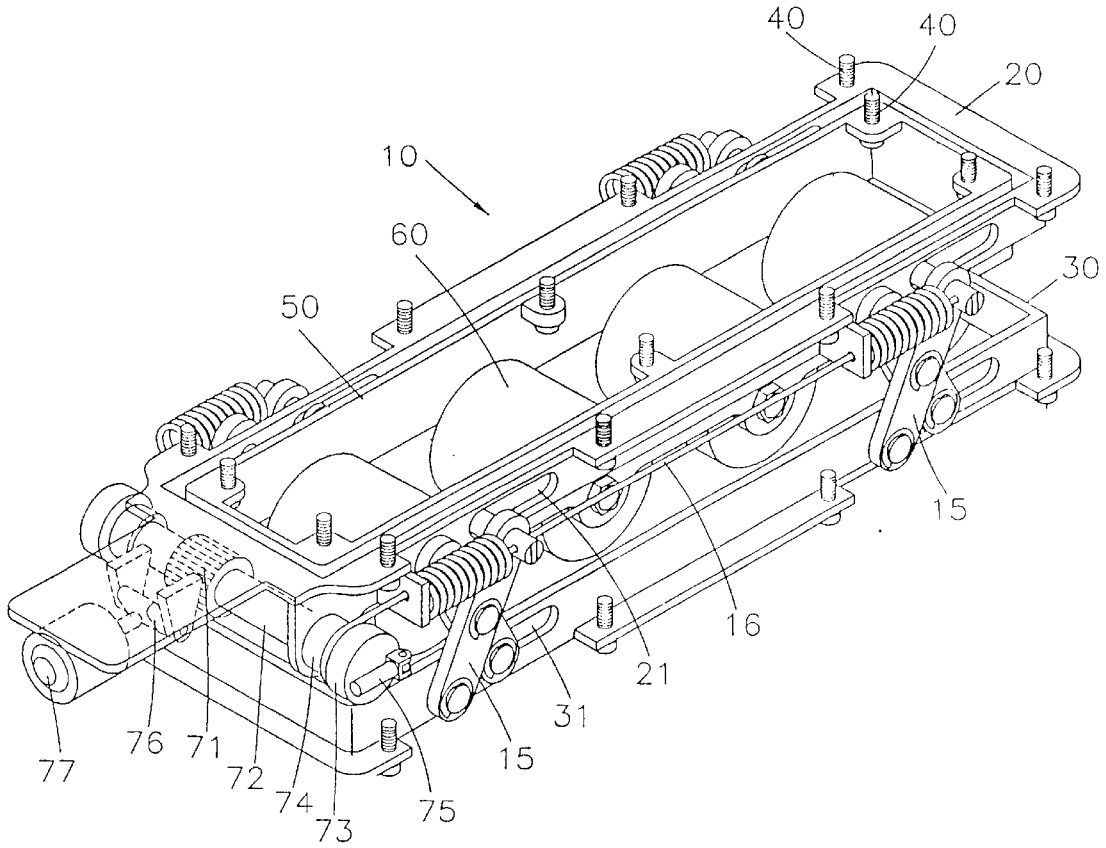
FIG. 2 is a perspective view of the hidden device in a multifunctional sports shoe shown in FIG. 1 in a state of being assembled.

Referring to FIGS. 1, and 2, a hidden device according the present invention is positioned under the bottom sole of a shoe body (not shown). The hidden device basically comprises a roller mechanism 10 and an actuation mechanism 70. The roller mechanism 10 further comprises an upper base frame 20, a lower base frame 30, a roller frame 50, and a plurality of arranged skating rollers 60. The roller frame 50 is fixedly attached to the bottom sole by way of threaded fasteners 40. The rollers 60 are rotatably mounted in the roller frame 50. The actuation mechanism 70 is provided on the upper base frame 20. Further, the actuation mechanism 70 comprises a ratchet wheel 71, a shaft 72, a rotary disk 73, a rolling wheel 74, a turning stem 75, a ratchet stop 76, and a press knob 77. The ratchet wheel 71 is fixed to the shaft 72, and the rotary disk 73 and the rolling wheel 74 are attached to both ends of the shaft 72 respectively. The turning stem 75 is attached to the rotary disk 73 for being able to rotate the rotary disk 73. The ratchet stop 76 is positioned to movably engage with the ratchet wheel 71 to be moved by the press knob 77.

Furthermore, each of two longitudinal lateral sides on the upper base frame 20 provides a sliding groove 21 near both ends thereof respectively. Each of two longitudinal lateral sides on the lower base frame 30 also provides a sliding groove 31 near both ends thereof respectively corresponding to the respective sliding groove 21. An actuating arm 15 at the upper end thereof is slidably attached to the respective sliding groove 21 and at the lower end thereof is pivotally attached to the lower base frame 30. Another actuating arm 15 at the lower end thereof is slidably attached to the respective sliding groove 31 and at the upper end thereof is pivotally attached to the upper base frame 20. Thus, these two actuating arms 15 engage with each other crossly to constitute a pair of cross arms 15, 15. A respective elastic cord 16 connects two pairs of cross actuating arms 15, 15 at respective longitudinal lateral side of the upper and the lower base frame 20, 30 for slidably moving the connected pairs of cross actuating arms 15, 15.

As soon as the press knob 77 is pushed, the lower base frame 30 may rise to expose the rollers 60 for skating. Once the turning stem 75 is actuated to turn the rotary disk 73, the lower base frame 30 may descend to original position for walking.

Referring to FIGS. 1 and 2 again, a detail regarding assembling the preceding parts will be described hereinafter. First of all, the rollers 60 are pivotally fixed to the roller frame 50. Then, the threaded fasteners 40 thereon are fastened to the bottom sole of a shoe. The upper base frame 20 and the lower base frame 30 are join to each other by way of four pairs of cross arms 15, 15. Two of the four pairs of cross arms 15, 15 at the same side have the upper ends thereof movably connect with an elastic cord 16 respectively. The respective elastic cord 16 is also wound on the rotary wheel 74 of the actuating mechanism 70. The press knob 77 keeps contact with the ratchet stop 76. Meanwhile, the upper base frame 20 and the lower base frame 30 are fastened to the bottom sole by way of other threaded fasteners 40. In addition, parts of the actuating mechanism 70 are fixed in the bottom sole either.

Figure 3:
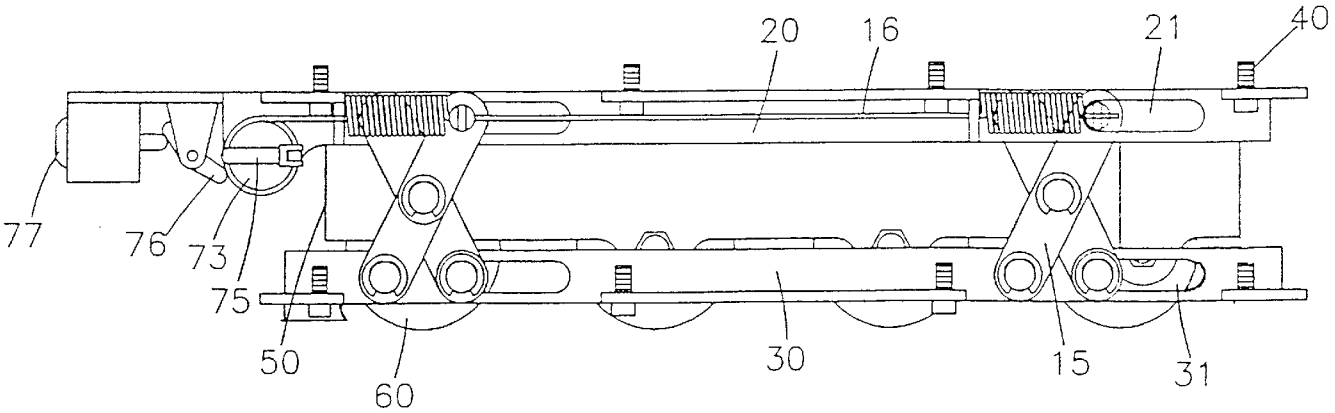
FIG. 3 is a plan view of the hidden device in a multifunctional sports shoe shown in FIG. 2 illustrating the hidden device in a state of concealing.
Figure 4:
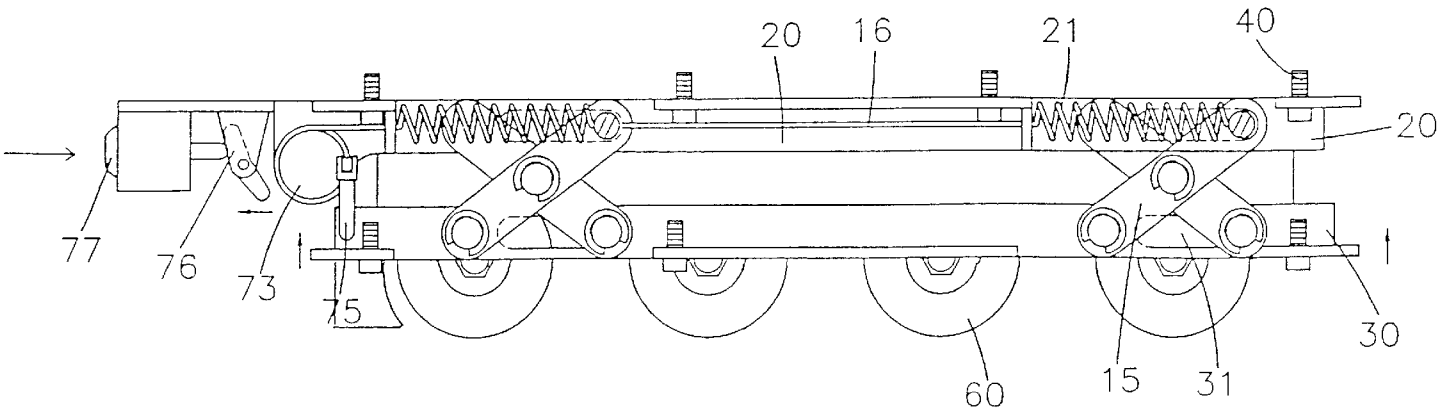
FIG. 4 is a plan view similar to FIG. 3 illustrating the hidden device in a state of being revealed.
Figure 5:
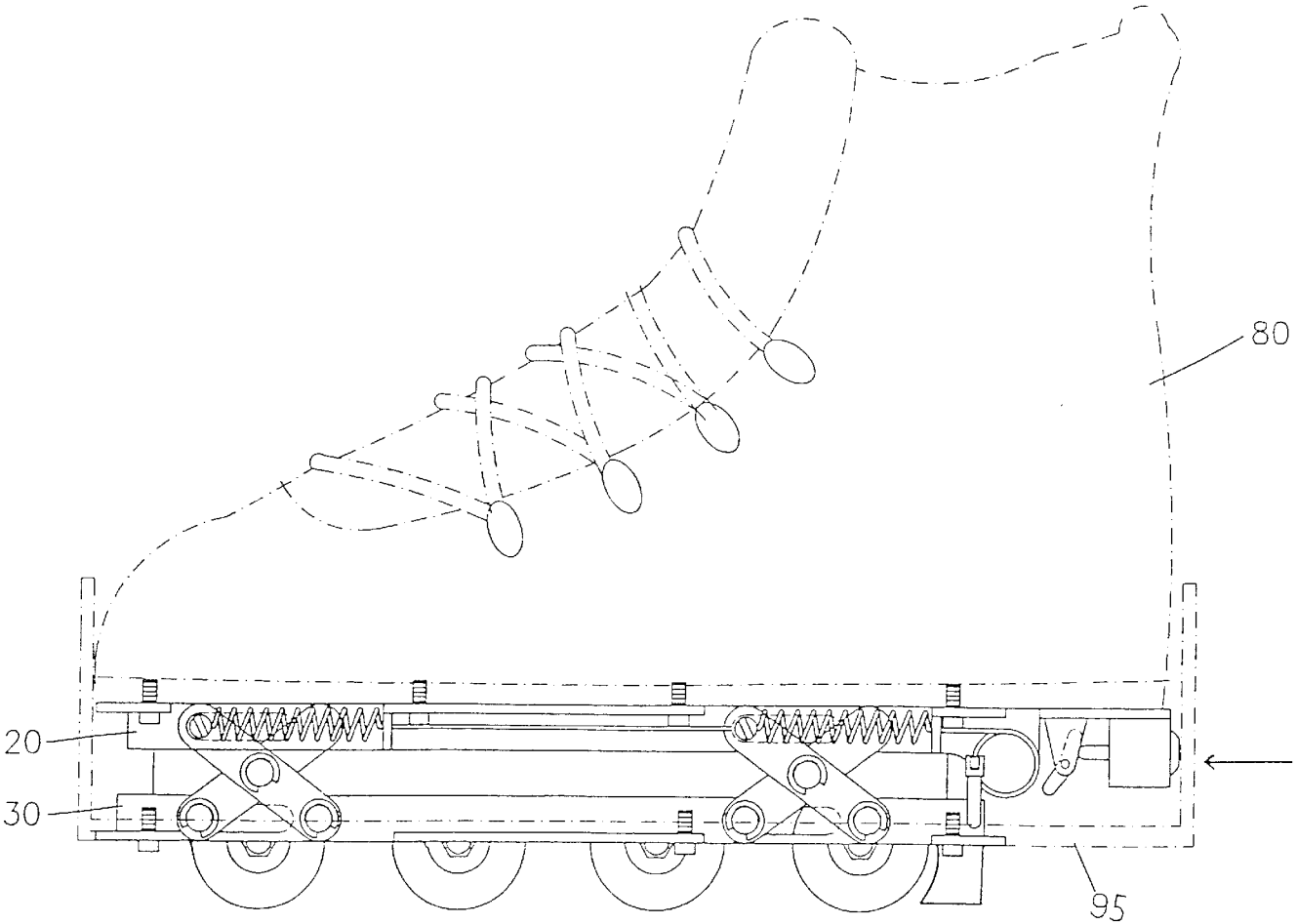
FIG. 5 is a plan view of the revealed hidden device being associated with a shoe body.

Referring to FIGS. 3 to 5, the operation for actuating the hidden device of the present invention is illustrated. When the skating rollers 60 are to be used for sports, the press knob 77 of the actuation mechanism 70 is pushed to actuate the ratchet stop 76 away the ratchet wheel 71. Then, the shaft 72 may rotate caused by the elastic force of the elastic cord 16, which is wound on the respective rolling wheel 74. Each pair of cross arms 15, 15, which connect with the elastic cord 16 at either lateral side of upper and lower base frames 20, 30 may slide away to each other in guiding grooves 21, 31. In this way, the lower base frame 30 may move upward to a preset position and the skating wheels 60 may expose for skating.

Oppositely, when the skating rollers 60 are not in use, the turning stem 75 on the rotary disk 73 can be pulled outward and turned clockwise or counterclockwise in accordance with the designed direction. That is, the elastic cord 16 is wound on the rolling wheel 74 to pull each pair of cross arms 15, 15 at either lateral side of upper and lower base frames 20, 30. In this way, each pair of cross arms 15, 15 may slide in guiding grooves 21, 31 inward and the lower base frame 30 move downward to the original position thereof. As soon as the manual turning force on the turning stem is stopped, the ratchet stop 76 may contact the ratchet wheel 71 to retain the shaft in a state of being unmoved. Hence, the skating rollers 60 under the shoe are concealed again for walking.

It should be noted that a bottom sole cover 95 is provided to fix with the lower base frame 30 by way of threaded fasteners. Thus, the roller mechanism 10 is covered by the bottom sole cover 95 and may not be seen from outside. While the lower base frame 30 is moved upward, the bottom sole cover 95 may be moved upward at the same to expose skating rollers for skating. While the lower base frame 30 is moved downward together with the bottom sole cover 95, the skating rollers are covered to form an ordinary sports shoe.

Figure 6:
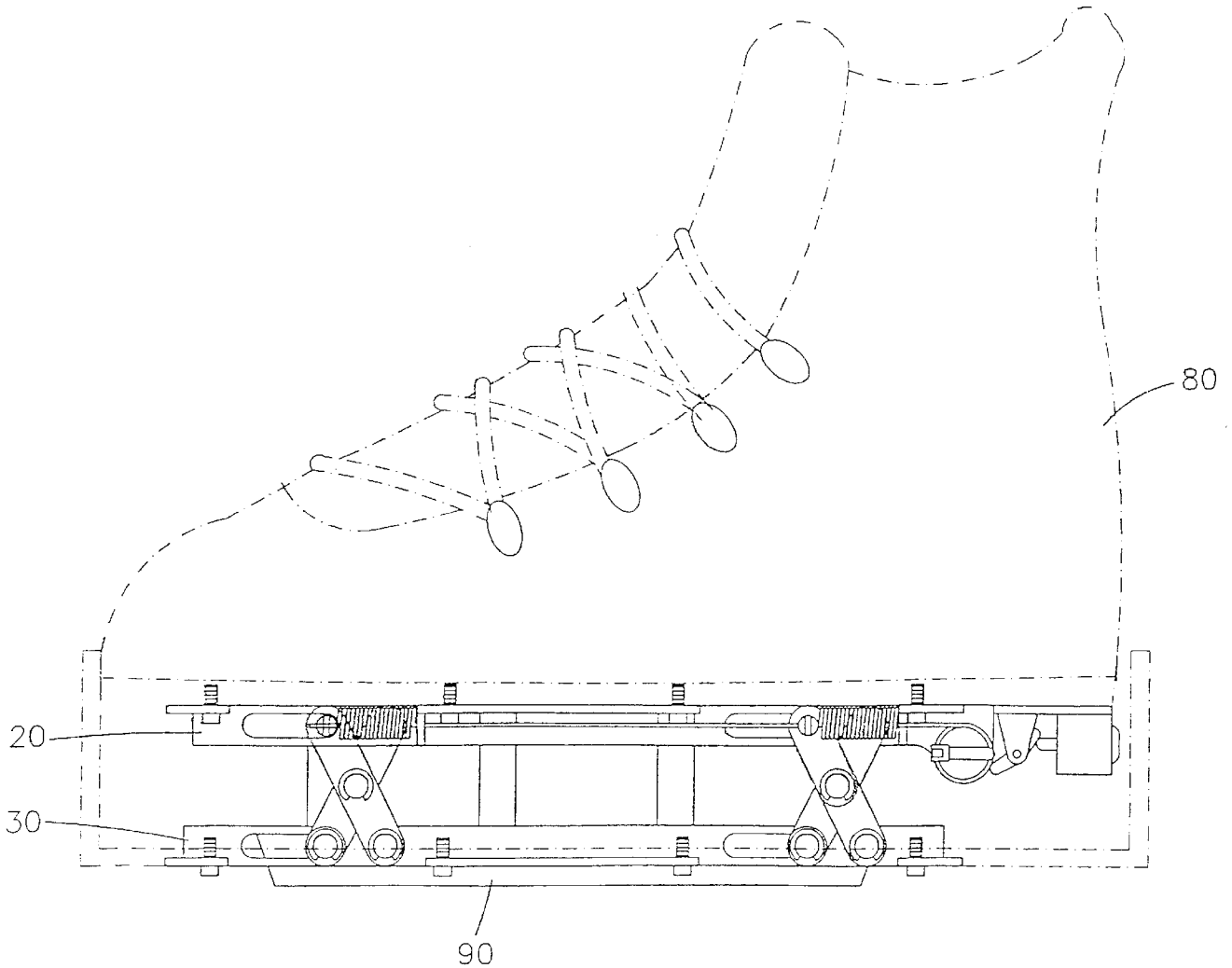
FIG. 6 is a plan view similar to FIG. 5 illustrating a skating edge in place of the rollers in the hidden device.

In addition, a skating edge device 90 may be mounted in place of the skating rollers under the bottom sole 80 as shown in FIG. 6 for bob skating. Therefore, the present invention is possible to offers the user another choice with multiple functions.

It is appreciated that the present invention overrides the structure of conventional shoe and provides much more useful and convenient shoe and the advantages of present invention are summarized hereinafter:

1. The present invention is simple and convenient for operation and use.
2. The present invention provides multiple purposes usefully.
3. The present invention is made with low cost from the economical consideration.
4. The present invention offers consumers different choices while using the shoe to save expense of buying other shoes.

While the invention has been described with referencing to a preferred embodiment thereof, it is to be understood that modifications or variations may be easily made without departing from the spirit of this invention, which is defined by the appended claims.

What is claimed is:

1. A hidden device in a multifunctional sports shoe, comprising:

a roller mechanism, being disposed under a bottom sole of the shoe; and an actuation mechanism, being attached to the roller mechanism;

wherein, the roller mechanism further comprising an upper base frame with two opposite longitudinal lateral sides, being fixedly attached to the bottom sole, and each of said two lateral sides near both ends thereof having an elongated sliding groove respectively;

a lower base frame with two opposite longitudinal lateral sides, being disposed below the upper base frame, each of said two lateral sides near both ends thereof having an elongated sliding groove respectively corresponding to the upper base frame;

four pairs of cross arms, each of said four pairs of cross arms being composed of a first actuating arm and a second actuating arm, the first actuating arm at an upper end thereof being slidably attached to one of the sliding grooves on the upper base frame by way of a connecting pin and at an lower end thereof being pivotally attached to the lower base frame, the second actuating arm at a lower end thereof being slidably attached to one of the sliding grooves on the lower base frame adjacent the preceding sliding groove on the upper base frame and at an upper end thereof being pivotally attached to the upper base frame, said first and second actuating arms movably engaging with each other via a center pivot;

a roller frame, being fixedly attached to the bottom sole by way of threaded fasteners, and being disposed in the upper base frame; and a plurality of skating rollers, being lined up and rotatably mounted in the roller frame; and the actuation mechanism further comprising a shaft with two ends, being disposed next to an end of the lower base frame transversely;

a ratchet wheel, being fixedly attached to the shaft;

two rolling wheels, being fixedly attached to the shaft near both ends thereof respectively;

two elastic cords, being disposed at said two lateral sides of the upper base frame respectively, each of said two elastic cords being wound on the respective rolling wheel in a state of stretching, and engaging with two of said four pairs of cross arms at either side;

a rotary disk, being joined to an end of the shaft;

a turning stem, being attached to the rotary disk;

a ratchet stop, being a flat piece and detachably engaging with the ratchet wheel; and a press knob, connecting with the ratchet stop for being operated to move the ratchet stop;

whereby, while the skating rollers are to be used for sports, the press knob is pushed to actuate the ratchet stop away the ratchet wheel, and the elastic forces of the elastic cords cause said four pairs of cross arms to be pulled inward and result in the lower base frame moving upward to a preset position and exposing the skating wheels for skating; and while the skating rollers are not in use, the turning stem on the rotary disk can be turned to cause the respective elastic cord being wound on the respective rolling wheel so as to move said pairs of cross arms outward downward to a stowed position.

2. The hidden device in a multifunctional sports shoe as defined in claim 1, wherein a bottom sole cover is fastened to the lower base frame to cover the roller mechanism when the skating roller is not in use.

* * * * *